US007470107B2

(12) United States Patent
Chen

(10) Patent No.: US 7,470,107 B2
(45) Date of Patent: Dec. 30, 2008

(54) TURBO BLOWER STRUCTURE

(76) Inventor: Ging-Chung Chen, 112 Chung Shan N. Rd., Sec. 3, Damshui Taipei (TW)

( * ) Notice: Subject to any disclaimer, the term of this patent is extended or adjusted under 35 U.S.C. 154(b) by 110 days.

(21) Appl. No.: 11/508,310

(22) Filed: Aug. 23, 2006

(65) Prior Publication Data

US 2006/0280602 A1 Dec. 14, 2006

Related U.S. Application Data

(63) Continuation-in-part of application No. 11/236,511, filed on Sep. 28, 2005.

(30) Foreign Application Priority Data

Nov. 24, 2004 (TW) ..... 93218855 U

(51) Int. Cl.
*F04D 29/30* (2006.01)

(52) U.S. Cl. ..... 415/198.1; 415/206; 416/186 R; 416/223 B; 416/DIG. 2

(58) Field of Classification Search ..... 415/203, 415/204, 206, 198.1, 199.1, 199.2, 199.3; 416/183, 185, 186 R, 188, 223 B, DIG. 2
See application file for complete search history.

(56) References Cited

U.S. PATENT DOCUMENTS

| | | | | | |
|---|---|---|---|---|---|
| 163,710 | A | * | 5/1875 | White | 415/204 |
| 1,941,449 | A | * | 1/1934 | Sylvan | 415/203 |
| 2,084,463 | A | * | 6/1937 | Stalker | 415/199.2 |
| 2,311,024 | A | * | 2/1943 | Buchi | 415/204 |
| 2,336,716 | A | * | 12/1943 | Clements | 415/199.2 |
| 2,384,265 | A | * | 9/1945 | Sollinger | 416/188 |

* cited by examiner

*Primary Examiner*—Christopher Verdier
(74) *Attorney, Agent, or Firm*—Birch, Stewart, Kolasch & Birch, LLP

(57) ABSTRACT

A turbo blower, include an air hood provided with an air inlet and a turbine disposed within the air hood driven and rotated by a motor. The turbine consists of a plurality of guide vanes fitted between a circular base plate and a top plate. The turbo blower is characterized by the height of each of the guide vanes, commencing at a vane front end close to a center of the base plate, gradually decreases to a relatively lower point at a middle section of the guide vane, and the height of each of the guide vanes, commencing at the relatively lower point, gradually increases to a vane rear end, thereby forming a curved shape. The turbo blower is able to automatically decrease power consumption when the air inlet end or the air outlet end is obstructed, thereby reducing motor load.

3 Claims, 7 Drawing Sheets

TURBO BLOWER STRUCTURE

This application is a Continuation-in-part Application of co-pending application Ser. No. 11/236,511, filed on Sep. 28, 2005, the entire contents of which are hereby incorporated by reference and for which priority is claimed under 35 U.S.C. § 120. This application also claims priority under 35 U.S.C. § 119(a) on Patent Application No. 093218855 filed in Taiwan, Republic of China on Nov. 24, 2004, the entire contents of which are hereby incorporated by reference.

BACKGROUND OF THE INVENTION (a) Field of the Invention

The present invention relates to an improved structure for a turbo blower, and more particularly to a turbine blade which enables power consumption to automatically decrease when an air inlet end or air outlet end of the turbine is obstructed, thereby reducing motor load.

(b) Description of the Prior Art

FIG. 7 shows a turbine of a turbo blower of prior art primarily structured to include a plurality of radially arranged guide vanes b between a circular base plate a and a top plate a'. The radially arranged guide vanes b extend radially outward from close to the center of the base plate a towards the outer edge of the base plate a. Front vane ends b1 of the guide vanes b are positioned close to the center of the base plate a, the upper edge of each guide vane b forms a curve by gradually decreasing the height of the guide vane b from the front vane end b1 to the lowest point at a vane rear end b2, whereat the height of the guide vane b extends horizontally outward. The turbine is disposed in an air hood c, and a motor d directly or indirectly drives and rotates the turbine. The air hood c is provided with an air inlet c1 and an air outlet c2, wherein the air inlet c1 is located above a corresponding center portion (rotating center) of the turbine, and a circular hole al' is correspondingly defined in the turbine top plate a'. The air outlet c2 is correspondingly located on the outer edge of lateral to the turbine, thereby enabling air to be expelled from the air outlet c2 after being sucked into the turbine from the air inlet c1.

According to the aforementioned structure, a cylindrical space is formed by the front ends b1 of the guide vanes b to a center point when the motor d is driving and rotating the turbine at high speed, and a vacuum negative pressure is created within the cylindrical space, thereby enabling outside air to be sucked into the air inlet c1, whereafter the guide vanes b push the sucked-in air towards the rear ends b2 at the outer edges of the guide vanes b. The vane rear ends b2 of the guide vanes b then compresses the air to produce positive air pressure, which is then expelled through the air outlet c2.

However, the height of the vane rear ends b2 of the guide vanes b is relatively low (that is, effective area for wind shear is relatively small), a consequence of which easily results in an inadequate positive pressure to discharge air in the turbine of prior art turbo blowers. Such an undue prior art structure is acceptable for application in situations where air intake and air discharge requirements are not so stringent, for example, simple daily appliances, such as a vacuum cleaner, blast furnaces, and so on. Nevertheless, the turbo blower of prior art is inapplicable in situations where high pressure air is required because of the substantially large difference in value between negative pressure and positive pressure at the two ends when one end of the air inlet c1 or the air outlet c2 is obstructed, and thus, a multiple increase in rotating power driving the turbine results, a consequence of which gives prior art the shortcoming of increasing motor load that might easily cause the turbine to burn out.

SUMMARY OF THE INVENTION

In light of the shortcomings of the aforementioned structure of turbine blades of prior art, the inventor of the present invention, having accumulated years of experience in related arts, attentively and circumspectly carried out extensive study and exploration to ultimately design a new improved structure for a turbo blower.

A primary objective of the present invention is to provide an improved structure for a turbo blower that uses turbine blades designed to effectively control positive and negative air pressure produced by the turbine blades, thereby reducing motor load.

In order to achieve the aforementioned objective, the improved structure for the turbo blower of the present invention has principal characteristics which include the height of each guide vane, commencing at a vane front end close to the center of a base plate, gradually decreases to a relatively lower point at the middle section of the guide vane; circumferential area formed by the cross-sectional height at any position between the vane front end and the relatively lower point of each of the guide vanes when the rotating is identical; and the height of each of the guide vane, commencing at the relatively lower point, gradually increases the vane rear end, thereby forming a curved shape.

According to the aforementioned structure, the improved structure for the turbo blower of the present invention comprises a turbine, assembled from a plurality of the guide vanes fitted between a circular base plate and a top plate, disposed within an air hood. The air hood is provided with an air inlet and an air outlet, wherein the air inlet is located above a corresponding circular hole defined at a center portion of the top plate, and the air outlet is correspondingly located on the outer edge of the turbine. Since the vane rear end of each guide vane is relatively high, thus, when the turbine is rotating at high speed, the effective area at the vane rear ends beating the air becomes relatively large, which increases propulsive thrust on air located between the relatively lower point at the middle section of the guide vanes and the vane rear ends, thereby correspondingly increasing positive pressure (air displacement) of air discharge areas at the vane rear ends, and provides better air compression power (and greater air displacement). Moreover, when one of the sides of the air inlet or the air outlet of the turbine is obstructed, positive air pressure produced at the vane rear ends is again guided to the inside of the cylindrical space formed at the vane front ends of the turbine, wherein the negative air pressure and the positive air pressure cancel each other out, at which time the power consumption of the turbine does not increase but decreases, thereby achieving effectiveness of reducing motor load.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
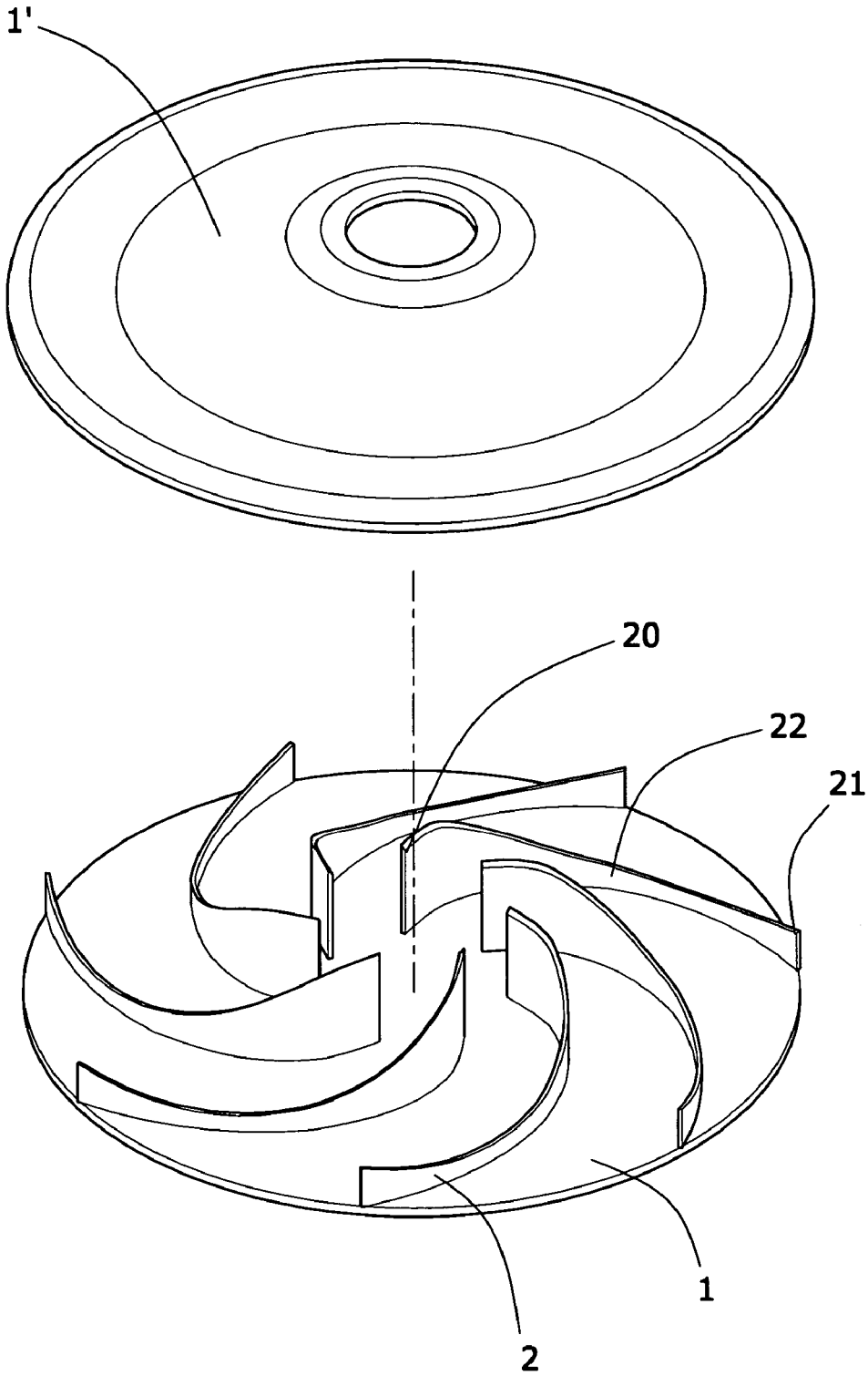
FIG. 1 shows an exploded elevational view of a turbine according to the present invention.
Figure 2:
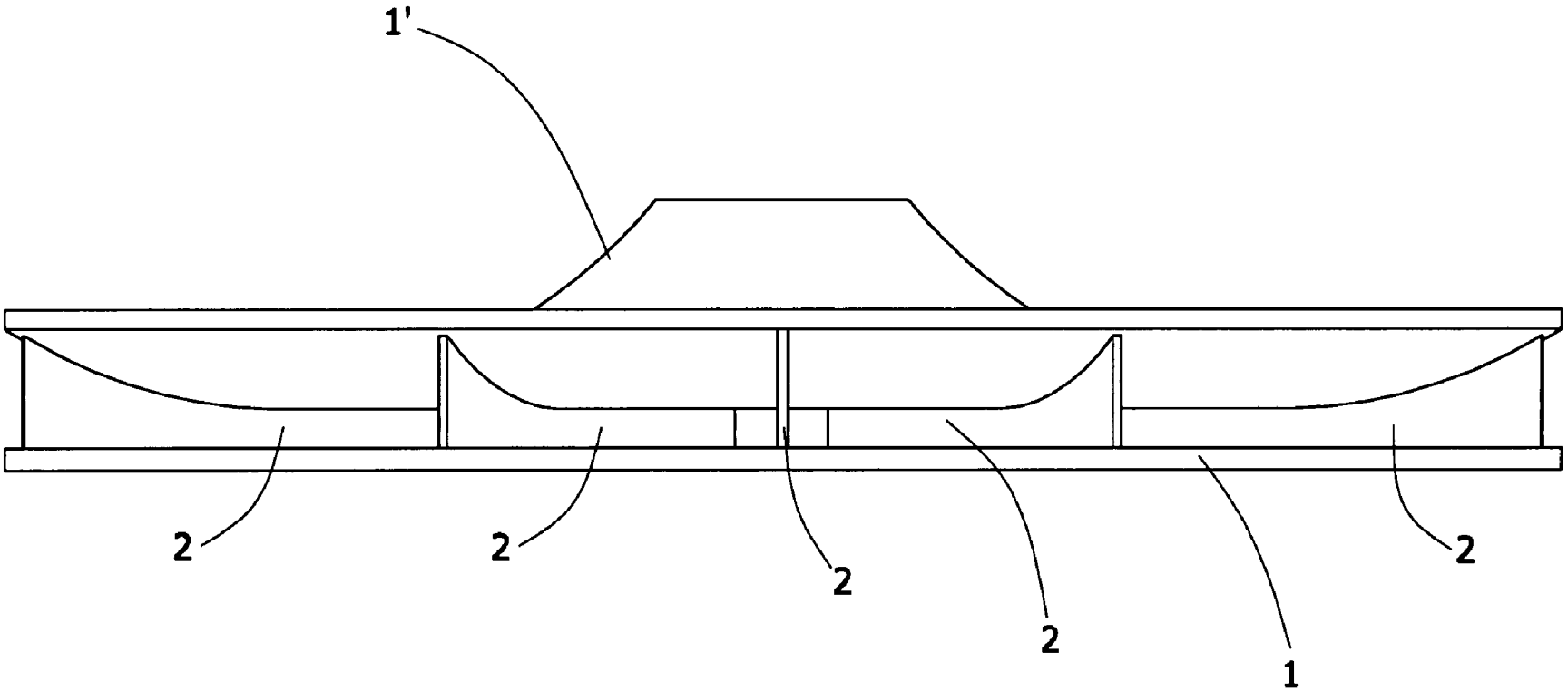
FIG. 2 shows an assembled side view of the turbine according to the present invention.
Figure 3:
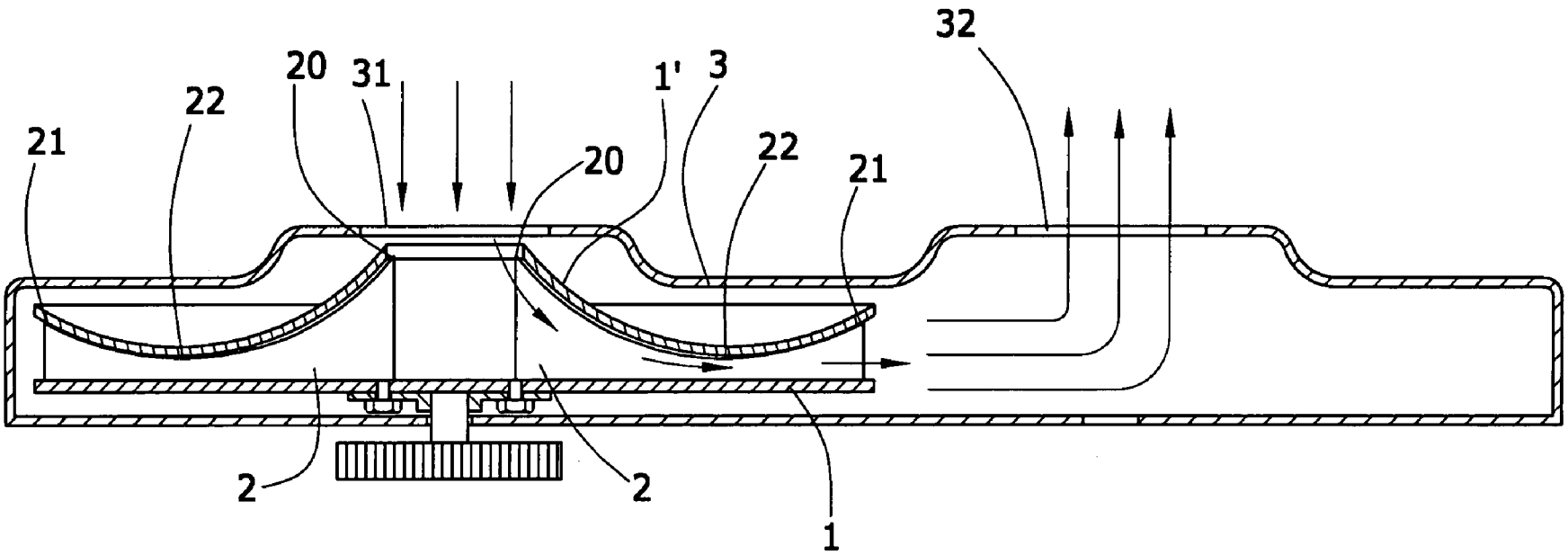
FIG. 3 shows a schematic view depicting air flow in the turbine of the present invention in use.

FIGS. 1, 2 and 3 show an improved structure for a turbo blower, where a turbine is primarily structured to comprise a plurality of guide vanes 2 configured between a circular base plate 1 and a top plate 1'. Each of the guide vanes 2 extend radially outward from close to the center of the base plate 1 towards the outer edge of the base plate 1, and the turbine is disposed within an air hood 3. The air hood 3 is provided with an air inlet 31 and an air outlet 32, wherein the air inlet 31 is located above a corresponding circular hole defined in a center portion of the top plate 1'. The air outlet 32 is correspondingly located lateral to the turbine. The present invention is characterized in that:

The height of each of the guide vanes 2, commencing at a vane front end 20 close to the center of the base plate 1, gradually decreases to a relatively lower point 22 at the middle section of the guide vane 2. Circumferential area swept out by rotation of a cross sectional height at any position between the vane front end 20 and the relatively lower point 22 is identical. Moreover, the height of each of the guide vanes 2, commencing at the relatively lower point 22, gradually increases to a vane rear end 21, thereby forming a curved shape.

Figure 4:
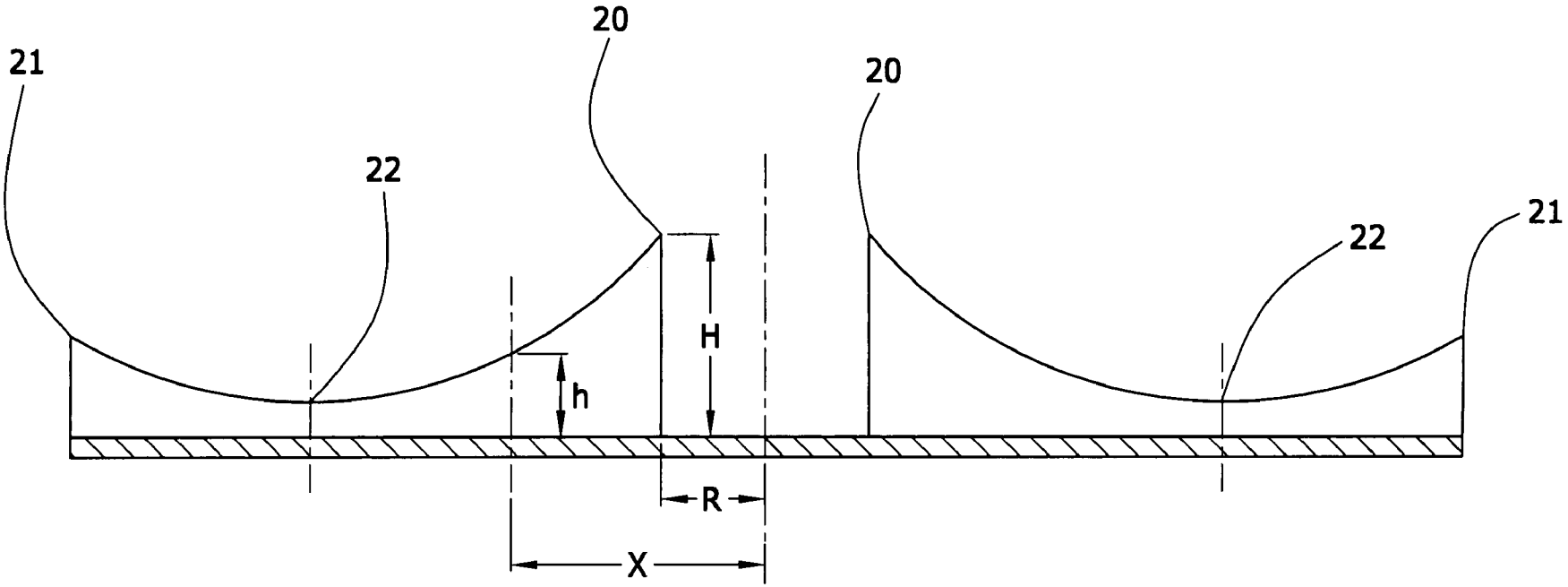
FIG. 4 shows a schematic view depicting an embodiment of a turbo blower according to the present invention.

Referring to FIG. 4 the design principle of the heights of the vane front end 20 of each of the guide vanes 2 and radius to the center of the base plate 1 is that the circumferential area of each cylindrical space is formed by each cross sectional height when the rotating is taken as a constant. For example:

If the height H of the vane front end 20 to the base plate 1 is 100 cm (which can be varied according to needs), and the distance R (that is, radius) from the vane front end 20 to the center point of the base plate 1 is 50, then the circumferential area ($\pi$ dh) of the cylindrical space is formed by the cross sectional height H of the vane front end 20 when the rotating equals 31416 $cm^2$. Moreover, the circumferential area of the cylindrical space is formed by the cross sectional height at any arbitrary point (X) between the vane front end 20 and the relatively lower point 22 when the rotating also equals the aforementioned value (31416 $cm^2$). For instance, if the distance of an arbitrary point (X) to the center point of the base plate 1 is 75, then height h of the arbitrary point (X)=31416 $cm^2/(\pi\times150)=66.667\ cm^2$, that is, the circumferential area of the cylindrical space is formed by the cross sectional height at any arbitrary point between the vane front end 20 and the relatively lower point 22 when the rotating is identical. Moreover, the rotation of the turbine attains a fixed negative air pressure suction at the vane front ends 20.

Furthermore, a multiple increase in driving power of the turbine results when the vane front ends 20 (negative pressure) or the vane rear ends 21 (positive pressure) of a prior art turbine are obstructed, which causes power dissipation or mechanical damage. However, modification in the shape of the guide vanes 2 of the present invention, whereby the height of each of the guide vanes 2, commencing at the relatively lower point 22, and gradually increasing to the vane rear end 21 (forming an involute curve), strengthens discharge pressure (positive pressure) of a pressure portion produced between the relatively lower point 22 and the vane rear end 21 of each of the guide vanes 2, and maintains a fixed air suction (negative pressure) at an air guide portion formed between the vane front end 22 and the relatively lower point 22 of each of the guide vanes 2, until the pressure portion and pressure of the air guide portion and air suction mutually cancel each other out, thereby reducing differential pressure therebetween, which results in a gradual reduction in power consumption of the turbine, and thus achieves effectiveness of reducing motor load (according to experiments, when the present invention uses a 5 HP (Horse Power) motor to drive the turbine, under normal conditions, electric current strength is 15 A (amperes); when the air inlet 31 or the air outlet 32 of the turbine is obstructed, the current strength indicated on an avometer does not increase but decreases, gradually decreasing to approximately 5~3 A (amperes)).

Figure 5:
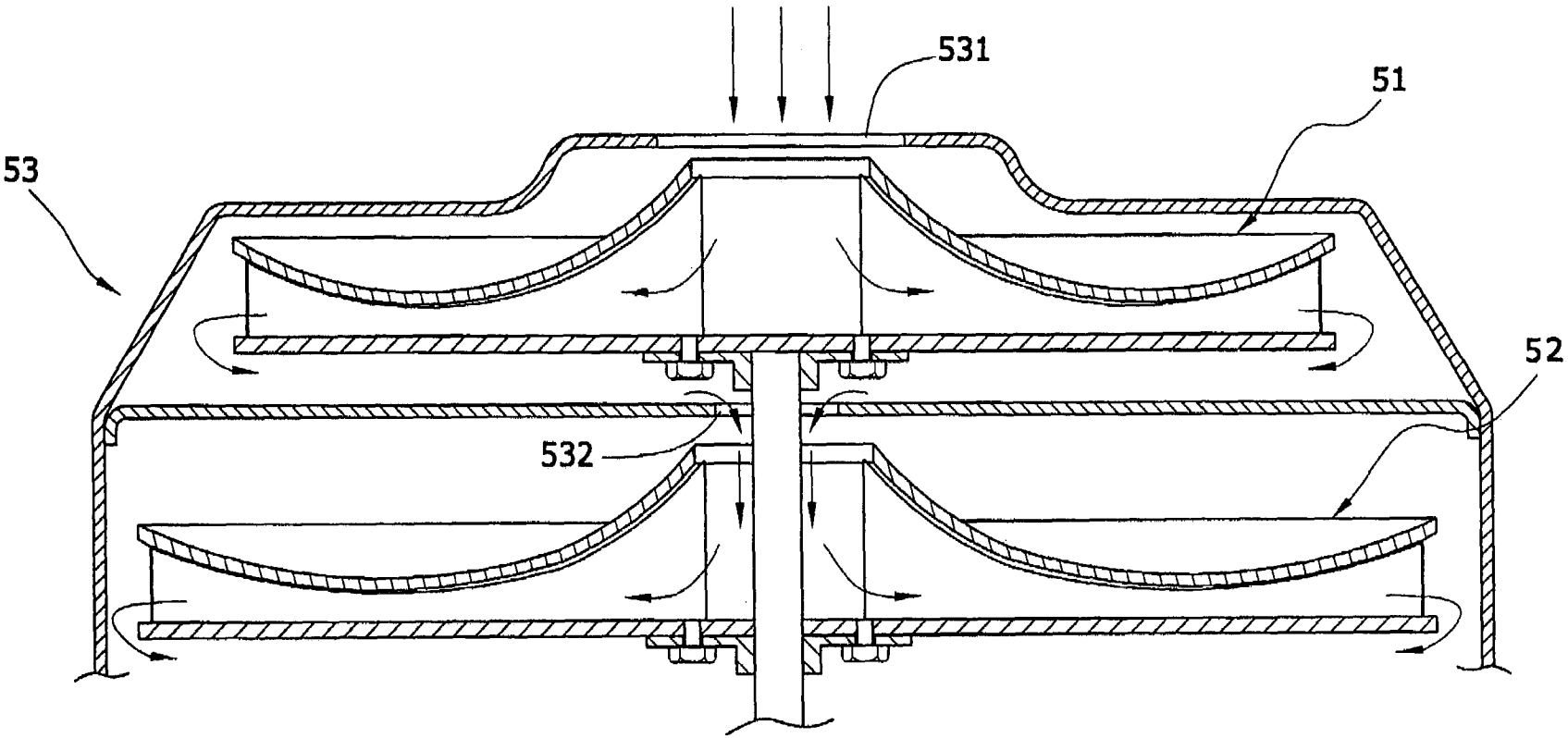
FIG. 5 shows a schematic view depicting another embodiment of the turbo blower according to the present invention.
Figure 6:
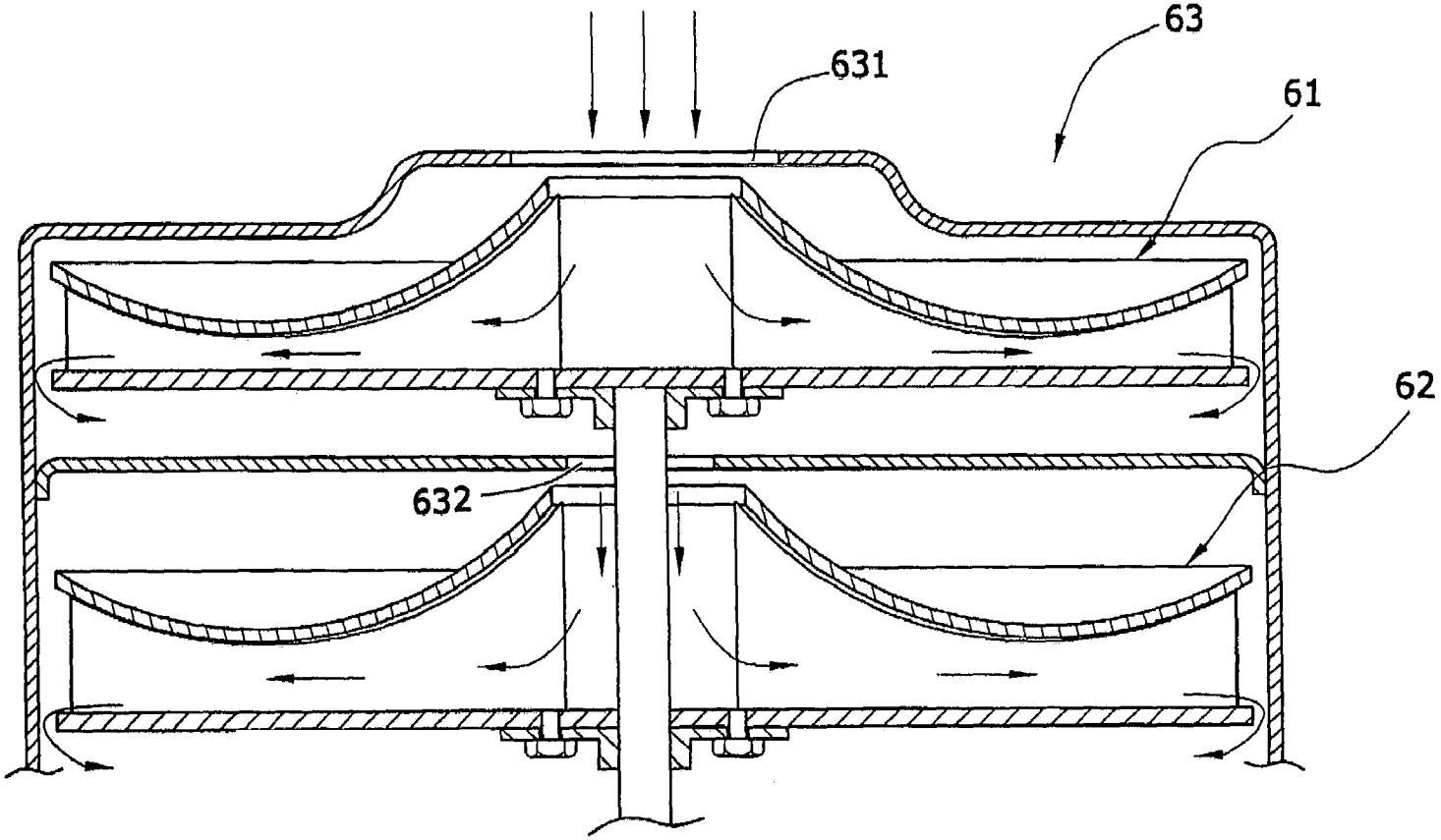
FIG. 6 shows a schematic view depicting yet another embodiment of the turbo blower according to the present invention.
Figure 7:
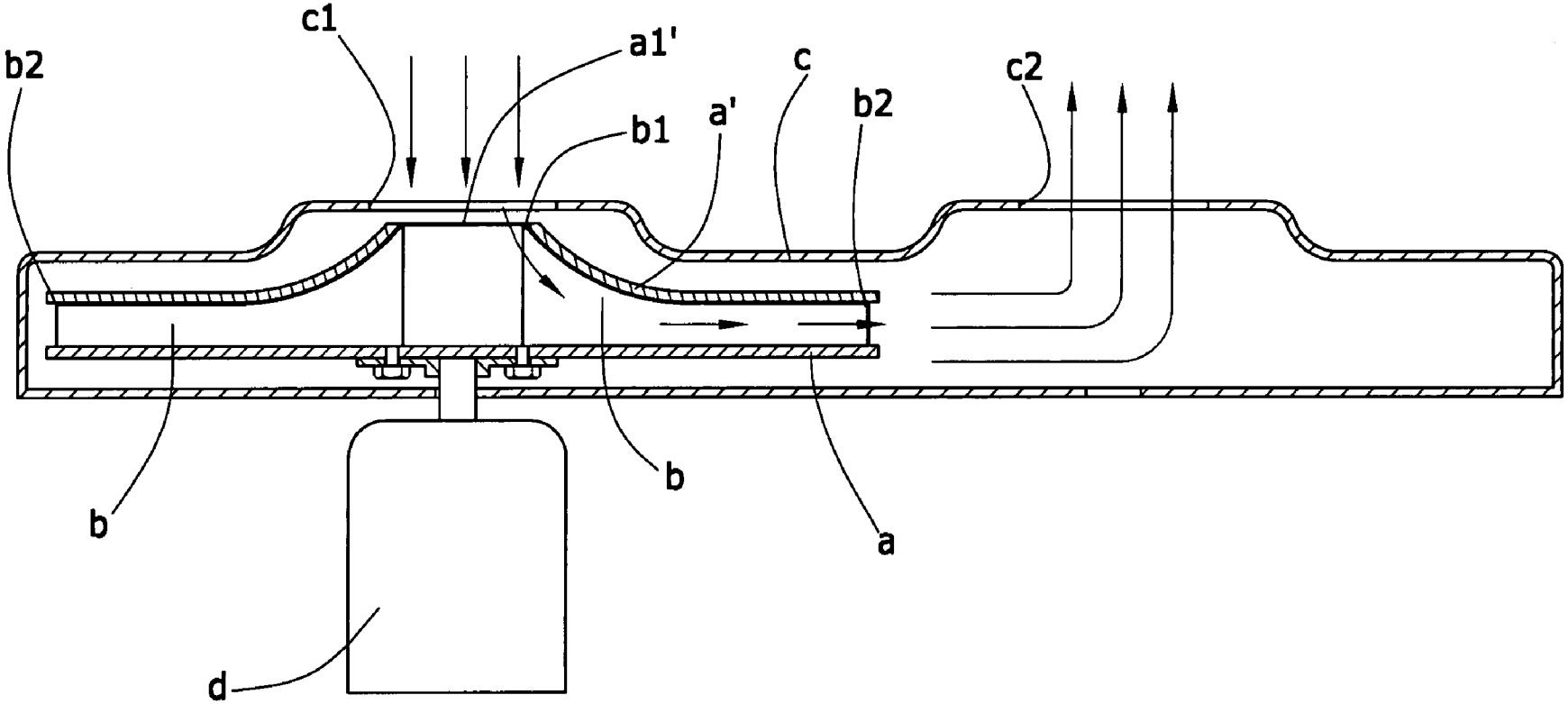
Fig.7(PRIOR ART)
FIG. 7 shows a side view depicting a turbo blower of prior art.

According to the aforementioned structure, in actual use, the present invention can comprise a plurality of identical or similar serial connected air blower structures (see FIG. 5 and FIG. 6). The structural configuration depicted in FIG. 5 comprises a primary turbine 51, a secondary turbine 52 and an air hood 53, wherein the diameter of the primary turbine 51 is smaller than that of the secondary turbine 52, which results in the air suction at an air inlet 531 of the primary turbine 51 being smaller than the air suction at a secondary air inlet (that is also the primary air outlet) 532, which further increases discharge/suction pressure and functional use. Reasoning by analogy, the present invention can further comprise a tertiary turbine or above. In like manner, FIG. 6 depicts a structural configuration using a secondary turbine 62 wherein the vane height is greater than that used in a primary turbine 61, thereby causing the air suction at a primary turbine air inlet 631 of an air hood 63 to be smaller than the air suction at a secondary air inlet (that is also the primary air outlet) 632, and thus achieving the objective of increasing discharge/suction pressure of the air blower.

In conclusion, the improved structure for the turbo blower of the present invention is able to assuredly achieve effectiveness of improving mechanical efficiency of the turbo blower and can reduce motor load, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A turbine for a turbo blower comprising a plurality of guide vanes fitted between a circular base plate and a top plate, each of the guide vanes extend radically outward from close to the center of the base plate towards the outer edge of the base plate, and the turbine is disposed within an air hood; the air hood is provided with an air inlet and an air outlet, wherein the air inlet is located above a corresponding circular hole defined in a center portion of the top plate; the turbine for a turbo blower is characterized in that: the height of each of the guide vanes, commencing at a vane front end close to the center of the base plate, gradually decreases to a relatively lower point at the middle section of the guide vane; circumferential area swept out by rotation of a cross sectional height at any position between the vane front end and the relatively lower point is identical, and the height of each of the guide vanes, commencing at the relatively lower point, gradually increases to a vane rear end, thereby forming a curved shape.

2. The turbine for a turbo blower according to claim 1, wherein two or more than two of the turbines can be dispersedly connected in series.

3. The turbine for a turbo blower according to claim 2, wherein the air suction at a primary air inlet is smaller than the air suction at a secondary air inlet of two or more than two turbines.

* * * * *